US011295914B2

(12) United States Patent
Hierl et al.

(10) Patent No.: US 11,295,914 B2
(45) Date of Patent: Apr. 5, 2022

(54) SURGE PROTECTION DEVICE HAVING A PLURALITY OF SURGE ARRESTERS AND, IN PARTICULAR THERMAL, ISOLATING APPARATUS WHICH IS RESPECTIVELY ASSOCIATED WITH THEM

(71) Applicant: DEHN SE + CO KG, Neumarkt (DE)

(72) Inventors: Stephan Hierl, Neumarkt (DE); Michael Waffler, Neumarkt/Opf. (DE)

(73) Assignee: DEHN SE + CO KG, Neumarkt (DE)

( * ) Notice: Subject to any disclaimer, the term of this patent is extended or adjusted under 35 U.S.C. 154(b) by 0 days.

(21) Appl. No.: 16/976,664

(22) PCT Filed: Oct. 15, 2019

(86) PCT No.: PCT/EP2019/077909

§ 371 (c)(1),
(2) Date: Aug. 28, 2020

(87) PCT Pub. No.: WO2020/078968

PCT Pub. Date: Apr. 23, 2020

(65) Prior Publication Data

US 2021/0366677 A1 Nov. 25, 2021

(30) Foreign Application Priority Data

Oct. 15, 2018 (DE) ..... 102018125520.9

(51) Int. Cl.
*H01H 37/76* (2006.01)
*H01H 37/22* (2006.01)

(52) U.S. Cl.
CPC ..... *H01H 37/761* (2013.01); *H01H 37/22* (2013.01); *H01H 2037/762* (2013.01)

(58) Field of Classification Search
CPC . H01H 37/761; H01H 37/22; H01H 2037/762
(Continued)

(56) References Cited

U.S. PATENT DOCUMENTS 7,411,769 B2 * 8/2008 Schimanski ..... H01T 4/06 335/6
7,738,231 B2 * 6/2010 Lagnoux ..... H01H 71/04 361/115

(Continued)

FOREIGN PATENT DOCUMENTS

DE 102007042991 A1 12/2008 ..... H01C 7/12
DE 102013006052 A1 8/2014 ..... H01T 1/14

(Continued)

OTHER PUBLICATIONS

The International Search Report, in English, dated Jan. 13, 2020, which was issued by the International Bureau of WIPO in Applicant's corresponding international PCT application having Serial No. PCT/EP2019/077909, filed on Oct. 15, 2019.

*Primary Examiner* — Anatoly Vortman
(74) *Attorney, Agent, or Firm* — Bodner & O'Rourke, LLP; Gerald T. Bodner; Christian P. Bodner

(57) ABSTRACT

An overvoltage protection device has a plurality of overvoltage arresters and a disconnecting apparatus. For each of the overvoltage arresters a blocking element is present, each of which is arranged so as to block the path of movement of a mechanically preloaded wedge slide having a wedge bevel. A rocker lever arrangement has first lever arms corresponding to the number of wedge slides and at least one second lever arm for blocking or releasing a displacement element, wherein ends of the first lever arms each have a surface for contacting the respective wedge bevel of the wedge slides in such a way that, when the respective path of movement is released, at least one of the wedge slides lifts the corresponding first lever arm with its wedge bevel, as a result of which the second lever arm releases the displacement element.

8 Claims, 5 Drawing Sheets

(58) Field of Classification Search
USPC ..... 337/404
See application file for complete search history.

(56) References Cited

U.S. PATENT DOCUMENTS

| | | | | |
|---|---|---|---|---|
| 8,477,469 | B2 * | 7/2013 | Depping | H01H 37/761 361/127 |
| 8,526,159 | B2 * | 9/2013 | Ludewig | H01C 7/126 361/124 |
| 9,007,163 | B2 * | 4/2015 | Duval | H01C 7/126 337/142 |
| 9,349,548 | B2 * | 5/2016 | Juricev | H01H 37/761 |
| 9,640,352 | B2 * | 5/2017 | Daum | H01T 1/14 |
| 10,049,795 | B2 | 8/2018 | Hirschmann et al. | |
| 10,090,086 | B2 * | 10/2018 | Ahlemeyer | H01C 7/12 |
| 10,629,399 | B2 * | 4/2020 | Li | H01H 71/08 |
| 2014/0313632 | A1 * | 10/2014 | Hirschmann | H01H 83/10 361/131 |

FOREIGN PATENT DOCUMENTS

| | | | | |
|---|---|---|---|---|
| DE | 202013012174 | U1 | 7/2015 | H01C 7/12 |
| DE | 102008026555 | B4 | 8/2016 | H01C 7/12 |
| DE | 102015014163 | A1 | 3/2017 | H01H 37/18 |

* cited by examiner (Initial state)

(Triggering stage 1)

(Triggering stage 1)

(Triggering stage 2)

(Triggering stage 2)

SURGE PROTECTION DEVICE HAVING A PLURALITY OF SURGE ARRESTERS AND, IN PARTICULAR THERMAL, ISOLATING APPARATUS WHICH IS RESPECTIVELY ASSOCIATED WITH THEM

TECHNICAL FIELD OF THE INVENTION

The invention is based on an overvoltage protection device having a plurality of overvoltage arresters and a disconnecting apparatus respectively associated with the plurality of overvoltage arresters, together with a fault and state display which is designed as a movable, spring force-preloaded displacement element and has a display surface and also an operating surface for a remote signaling device, wherein triggering of the fault and state display is performed indirectly by means of a blocking element, the physical state of which is changeable.

BACKGROUND OF THE INVENTION

From DE 20 2013 012 174 U1, an overvoltage protection device comprising at least one overvoltage arrester and a thermally triggerable switching device connected in series to the overvoltage arrester is already known.

The thermal triggering means is arranged in the area of the heating of the overvoltage arrester to be expected in case of its overload. The thermal triggering means is not designed as a stop member through which the operating and overvoltage current flows, which releases unlocking of the switching device in case of thermal overload.

The stop member is moreover thermally and mechanically coupled to an upper surface side of the overvoltage arrester and blocks the path of movement of a mechanically preloaded unlocking slide.

Into the unlocking slide, a contact platelet is inserted which establishes an electrical connection between elements of the switching device, wherein by the unlocking, the contact platelet is subjected to a displacement movement with the consequence of interrupting a series connection of the switching device. A portion of the unlocking slide is designed to be isolating in order to immerse into the separating area of the switching device and to guarantee a safe separating state there.

DE 20 2013 012 174 U1 moreover discloses a rocker which has rigid or elastic properties and is, for example, formed as a molded plastic part. The rocker is supported on a fixed point with a first rocker end. This fixed point may be realized by elements of the housing of the overvoltage protection device. A second rocker end engages a movable stop. It is decisive in this case that the rocker is capable of acting as an energy storage without causing parts of the rocker to fracture or break off.

The already known unlocking slide has a state display surface. This surface points toward the upper side of the housing of the plug-in part, for example, and exposes a display surface there, for instance green or red for the "okay" or "defect" state.

In the overvoltage protection device having a thermal disconnecting apparatus and a fault display according to DE 10 2008 026 555 B4, at least one varistor is associated to each arresting path therein. The thermal separating points are in series to the respective varistor. Chambers for receiving the varistors and a pivotably mounted lever with a display surface are present within a device housing.

The display surface is located in the area of a housing window.

Plug connections pass through the housing bottom so as to establish an electrical connection to a base member, wherein spring-preloaded brackets are formed which are electrically and mechanically connected to the respective varistor in each case via a low-melting solder.

The spring-preloaded brackets are formed by a single stamped bent part which, starting from a common connecting leg, has finger-like protrusions corresponding to the number of separating points, and wherein at least one plug connection is formed on the connecting leg. The already known solution enables a disconnection and fault display for each varistor and a corresponding visualization of the particular state.

The provided pivotably mounted lever for the fault display has a lever arm engaging into a space below the finger-like protrusions so as to be entrained, i.e. operated, during the disconnecting process by the respective moving protrusion. The pivotably mounted lever is held in a target position by a spring element, wherein the spring preloading force of the particular thermal separating points is larger than the retaining force of the spring element of the lever.

This retaining force merely serves the purpose of holding the display surface in its initial position as long as a faultless state is given.

The pivotable lever moreover comprises a pin engaging into a recess of the housing bottom so as to activate in the fault or disconnection event a micro push-button located within the base part for remote signaling.

It is true that the solutions of the state of the art depicted above are suitable to signal the disconnection of defective components, in particular of defective overvoltage arresters, the respective constructional implementation, however, is dependent on the constructional design and the position of the overvoltage arresters with their thermal separating points within a corresponding device housing.

From the aforementioned, it is therefore a task of the invention to propose a further developed overvoltage protection device having a plurality of overvoltage arresters and a thermal disconnecting apparatus respectively associated with them, together with a fault and state display, which has a universal and simple possibility of displaying and signaling a fault state according to an "OR" operation. Thereby, it is not important to recognize which one of the employed overvoltage arresters caused a triggering in the individual case. Rather, the solution to be created should be designed in terms of a collective display for the entire state of the arrester.

BRIEF SUMMARY OF THE INVENTION

An overvoltage protection device has a plurality of overvoltage arresters and a disconnecting apparatus associated with the plurality of overvoltage arresters, together with a fault and state display which is designed as a movable, spring force-preloaded displacement element and has a display surface and also an operating surface for a remote signaling device, wherein triggering of the fault and state display is performed indirectly by means of a blocking element, the physical state of which is changeable.

For each of the overvoltage arresters a blocking element is present, each of which is arranged so as to block the path of movement of a mechanically preloaded wedge slide having a wedge bevel.

A rocker lever arrangement has first lever arms corresponding to the number of wedge slides and at least one second lever arm for blocking or releasing the displacement element, wherein the ends of the first lever arms that are remote from an axis of rotation of the rocker lever arrangement each have a surface for contacting the respective wedge bevel of the wedge slides in such a way that, when the respective path of movement is released, at least one of the wedge slides lifts the corresponding first lever arm with its wedge bevel, as a result of which the second lever arm releases the displacement element.

Consequently, an overvoltage protection device having a plurality of overvoltage arresters is taken as a basis. These may be a plurality of varistors, spark gaps and/or gas arresters and any combinations thereof.

In each case, one disconnecting apparatus is associated with the respective overvoltage arresters so as to disconnect the arresters in case of trouble, i.e. in case of overload, from the mains.

The disconnecting apparatus is in particular realized as a thermal disconnecting apparatus. A thermal disconnecting apparatus may be designed as a switching element which has contacts fixed and held in electrical connection by a low-melting solder.

When the melting temperature is reached or exceeded, the physical state of the solder will change so that the respective switching device opens. In this respect, at least one of the contact elements of the switching device may be under mechanical preload.

The overvoltage device moreover comprises a fault and state display.

This fault and state display is configured as a movable, spring force-preloaded displacement element.

The displacement element has a display surface.

The display surface can be in relationship with a viewing window of the housing of the overvoltage device so that in case of a positional change of the display surface, a color change and thus an optical visualization of the respective state becomes possible.

Furthermore, the spring force-preloaded displacement element may have an operating surface for a remote signaling device, for example, a remote signaling switching device in terms of a micro push-button.

The triggering of the fault and state display is performed according to the invention indirectly via a blocking element, the physical state of which is changeable.

This blocking element may be a wax-like structure, a solder, a thermoplastic resin or a similar material.

According to the invention, such a blocking element is present for each overvoltage arrester.

The blocking element is arranged such that it blocks the movement path of a mechanically preloaded wedge slide having a wedge bevel.

This blocking state remains maintained until a change of the physical properties of the blocking element occurs, for example, if the blocking element melts.

Furthermore, a rocker lever arrangement is present.

The rocker lever arrangement has first lever arms corresponding to the number of wedge slides, and at least one second lever arm for blocking or releasing the displacement element.

The ends of the first lever arms that are remote from the axis of rotation of the rocker lever arrangement each have a surface for contacting the respective wedge bevel of the wedge slides in such a way that, when the path of movement is released by a change of the physical state of the respective blocking element, at least one of the wedge slides lifts the movable first lever arm with its wedge bevel. As a result, a pivoting movement of the second lever arm occurs which in this respect releases the displacement element so that the changed state can be visualized or remotely signaled.

In one embodiment of the invention, the paths of movement of the wedge slides run either in the same direction or in part in opposite directions, wherein, for contacting the respective wedge bevel independently of the direction of the respective path of movement, the first lever arms have an angular structure in the form of a contacting finger.

The end of the contacting finger pointing toward the wedge bevel has a preferably convex rounding.

In one configuration of the invention, the wedge slides each are mounted in a groove-like recess to be displaceable, wherein the path of displacement can be blocked by means of the mentioned blocking element and can be released when the physical state of the blocking element changes.

In this respect, the respective blocking element is arranged in a portion of the groove-like recess and is in thermal contact with the respective overvoltage arrester.

In one embodiment of the invention, the displacement element has a recess into which a latching hook engages, which in turn is formed at the second end of the lever arm and, where appropriate, is designed to be monobloc with the lever arm.

The rocker lever arrangement has a central axle beam from which the lever arms extend substantially perpendicular to the axis of the central axle beam.

The central axle beam and the lever arms may be configured as a monobloc part.

The central axle beam either is configured such as to have itself axle stubs at its ends engaging into a corresponding recess of a device housing. Alternatively, the axle beam may have a bilateral blind hole bore or a through bore, and may receive an axle pin or an axle bolt.

In a further development of the invention, the wedge slides can be configured as monolithic blocks. Alternatively, there is the option of configuring the wedge slide with its relevant wedge bevel as a part of an assembly of the respective overvoltage arrester.

BRIEF DESCRIPTION OF THE DRAWINGS

The invention will be explained in more detail below on the basis of an exemplary embodiment and with reference to Figures.

Shown are in.

DETAILED DESCRIPTION OF THE INVENTION

Figure 1:
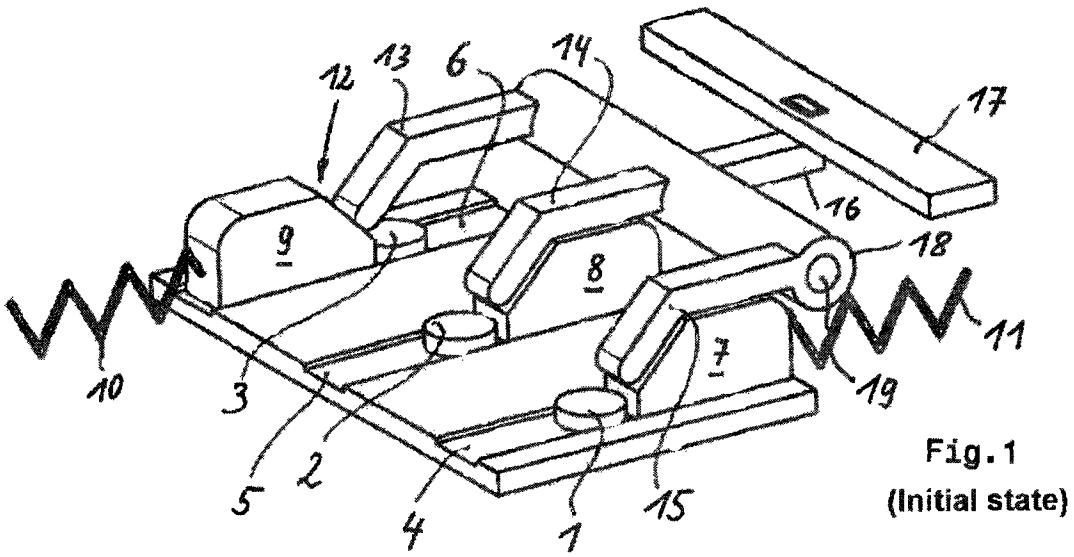
FIG. 1 a principle representation of the fault and state display having a wedge slide, a rocker lever arrangement and a spring force-preloaded displacement element in the initial state.

As a preliminary point, the attention is drawn to the fact that in the figurative representations used for the exemplary embodiment, the actual overvoltage arresters, which form an overvoltage protection device in their entirety, have been omitted just as the representation of housing parts or a total housing, or guiding elements for the displacement element and means for generating the spring force preload for the displacement element, or means for generating the mechanical preload for the blocking element shown in the middle in the Figures.

The illustrated quasi collective display in the exemplary embodiment for analyzing the state of, for example, three overvoltage arresters of an overvoltage protection device (not shown) takes three blocking elements 1, 2 and 3 as a basis.

Each blocking element is positioned such as to be capable of blocking paths of movement 4, 5 and 6 of a mechanically preloaded wedge slide 7, 8 and 9.

If the blocking elements 1, 2 and 3 are a pill of a low-melting solder material, for example, a physical change of state occurs along with reaching or exceeding the melting temperature. The corresponding pill changes its shape and may be displaced completely or in part by the wedge slides 7, 8 and 9, which are under spring preload.

The mechanical preload for the wedge slides is generated by the spring elements 10 and 11, respectively, represented in a symbolic manner.

The corresponding wedge slides each have a wedge bevel 12.

Moreover, a rocker lever arrangement is present which has first lever arms 13, 14, 15 corresponding to the number of the wedge slides 7, 8, 9.

Opposite the lever arms 13, 14, 15, at least one second lever arm 16 is located serving to block or release a displacement element 17.

The rocker lever arrangement comprises a central axle beam 18 having an axis of rotation 19.

The ends of the first lever arms 13, 14, 15 that are remote from the axis of rotation 19 of the rocker lever arrangement each have a surface 20 for contacting the respective wedge bevel 12 of the corresponding wedge slides 7, 8, 9.

Figure 2:
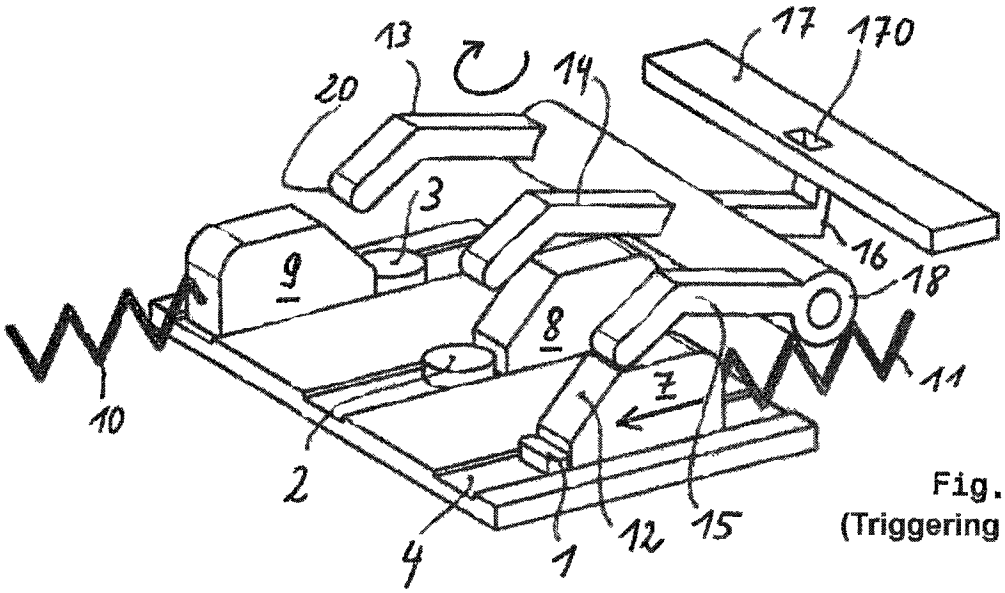
FIG. 2 a representation similar to that of FIG. 1, but with a displacement element triggered by way of example due to a change of the physical state of the blocking element which is on the right side in the Figure.

This contacting is performed in such a way that, when the path of movement 4 according to FIG. 2 is released, the wedge slide 7 lifts the first lever arm 15 while utilizing the force of the spring 11 and the wedge bevel 12.

As a result, the second lever arm 16 descends.

Figure 3:
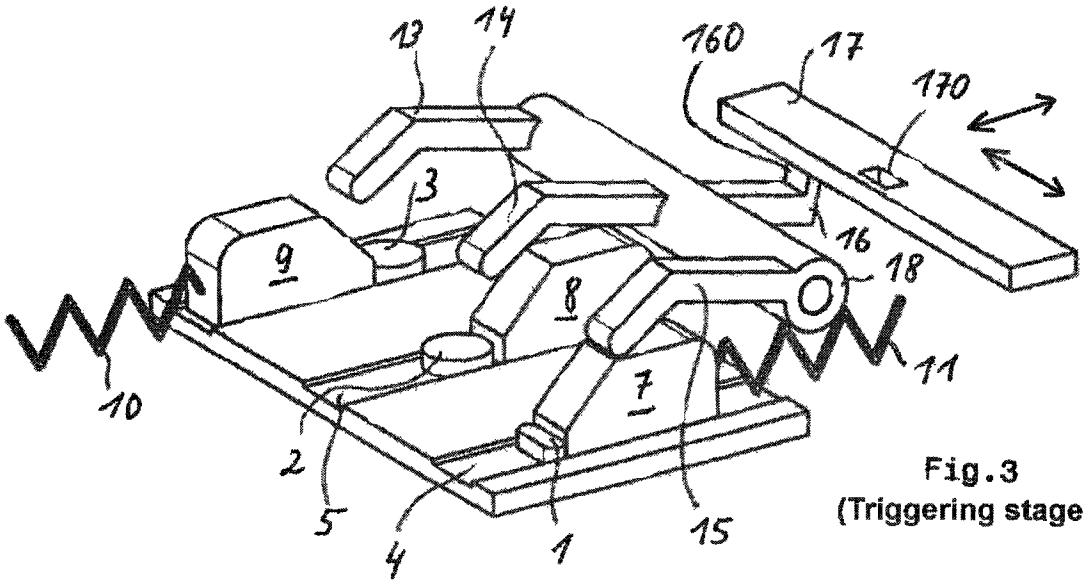
FIG. 3 the second triggering stage in which the displacement element after having been released can be displaced by a spring arrangement not shown, so as to activate, for example, an optical state display, or to cause itself directly a change of such an optical state display, or else to operate or trigger a remote signaling means directly or indirectly, and FIG. 3*a* the second triggering stage subsequently resulting from the physical change of state of the left-side blocking element shown in FIGS. 2*a* and 3*a*.
Figure 3A:
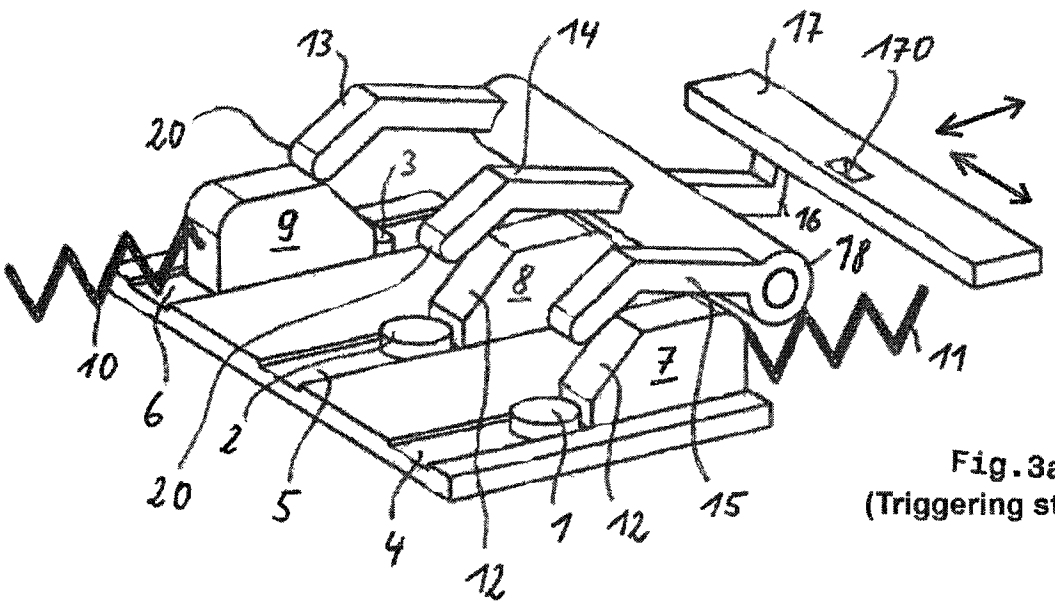

A latching hook 160 exits a recess 170 in the displacement element 17. Depending on the force of a spring preload acting upon the displacement element 17, this element can now make a movement such as symbolized in FIGS. 3 and 3*a* by the arrow representation.

Figure 2A:
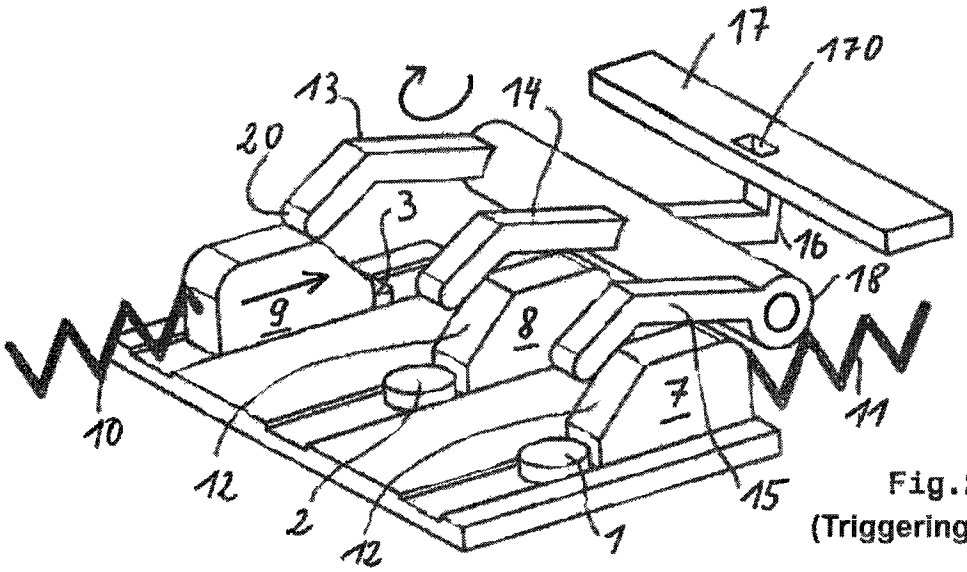
FIG. 2*a* a representation similar to that of FIG. 2, but with a displacement element triggered by way of example due to a change of the state of the blocking element which is on the left side in FIG. 2*a;*

It becomes obvious from the comparison of FIGS. 2 and 2*a* that the paths of movement 4 and 6 regarding the corresponding wedge slides 7 and 9 run in opposite directions.

For contacting also in this respect opposite movement directions of the corresponding wedge slides, and different positions of the wedge bevels 12 resulting therefrom, the first lever arms 13, 14, 15 are angled, i.e. the lever arms have a contacting finger, wherein the end of the contacting finger pointing toward the wedge bevel has a convex rounding as can be seen from the Figures.

In relation to the configuration of the paths of movement, the wedge slides 7, 8, 9 are mounted to be displaceable in a relevant groove-like recess, which is likewise clear from the Figures.

It is understood that the blocking elements 1, 2 and 3 are in thermal contact with the respective not shown overvoltage arrester so as to change their physical state when the respective overvoltage arrester is correspondingly overloaded and they are correspondingly heated, and to release the corresponding path of movement and thus the possibility of moving for the corresponding wedge slide.

The relevant elements such as the wedge slide, the displacement element but also the rocker lever arrangement can be manufactured in a cost-efficient manner from plastic material by usual injection or pressing processes.

After the spring force-preloaded displacement element is released, it cannot only signalize a fault state visually but also serve to operate a micro switch directly or indirectly so as to realize in this respect a remote signaling of the fault state.

The invention claimed is:

1. An overvoltage protection device having a plurality of overvoltage arresters and a thermal disconnecting apparatus associated with the plurality of overvoltage arresters, together with a fault and state display which is designed as a movable, spring force-preloaded displacement element and has a display surface and also an operating surface for a remote signaling device, wherein triggering of the fault and state display is performed indirectly by means of a blocking element, the physical state of which is changeable, wherein for each of the overvoltage arresters a blocking element is present, each of which is arranged so as to block the path of movement of a mechanically preloaded wedge slide having a wedge bevel, a rocker lever arrangement has first lever arms corresponding to the number of wedge slides and at least one second lever arm for blocking or releasing the displacement element, wherein the ends of the first lever arms that are remote from an axis of rotation of the rocker lever arrangement each have a surface for contacting the respective wedge bevel of the wedge slides in such a way that, when the respective path of movement is released, at least one of the wedge slides lifts the corresponding first lever arm with its wedge bevel, as a result of which the second lever arm releases the displacement element.

2. The overvoltage protection device according to claim 1, wherein the paths of movement of the wedge slides run in the same direction or in opposite directions, wherein, for contacting the respective wedge bevel independently of the direction of the respective path of movement, the first lever arms have an angular structure in the form of a contacting finger, wherein the end of the contacting finger pointing toward the wedge bevel has a convex rounding.

3. The overvoltage protection device according to claim 1, wherein the wedge slides each are mounted in a groove-like recess to be displaceable.

4. The overvoltage protection device according to claim 3, wherein the respective blocking element is arranged in a portion of the groove-like recess and is in thermal contact with the respective overvoltage arrester to be monitored.

5. The overvoltage protection device according to claim 1, wherein the displacement element has a recess into which a latching hook engages, which is formed on the second lever arm.

6. The overvoltage protection device according to claim 1, wherein the rocker lever arrangement has a central axle beam from which the lever arms extend.

7. The overvoltage protection device according to claim 6, wherein the central axle beam and the lever arms are configured as a monobloc part.

8. The overvoltage protection device according to claim 1, wherein the wedge slides are configured as a monolithic block or as a part of an assembly of the respective overvoltage arrester.

* * * * *